US012616238B2

(12) United States Patent
Soffe et al.

(10) Patent No.: US 12,616,238 B2
(45) Date of Patent: May 5, 2026

(54) AEROSOL GENERATION

(71) Applicant: Nicoventures Trading Limited, London (GB)

(72) Inventors: Joanna Soffe, London (GB); Thomas Leah, London (GB)

(73) Assignee: NICOVENTURES TRADING LIMITED, London (GB)

( * ) Notice: Subject to any disclaimer, the term of this patent is extended or adjusted under 35 U.S.C. 154(b) by 347 days.

(21) Appl. No.: 18/041,583

(22) PCT Filed: Aug. 13, 2021

(86) PCT No.: PCT/EP2021/072599
§ 371 (c)(1),
(2) Date: Feb. 14, 2023

(87) PCT Pub. No.: WO2022/034215
PCT Pub. Date: Feb. 17, 2022

(65) Prior Publication Data

US 2023/0292820 A1 Sep. 21, 2023

(30) Foreign Application Priority Data

Aug. 14, 2020 (GB) ..... 2012723

(51) Int. Cl.

| | |
|---|---|
| ***A24D 1/20*** | (2020.01) |
| ***A24B 15/16*** | (2020.01) |
| ***A24B 15/30*** | (2006.01) |
| ***A24F 40/20*** | (2020.01) |

(52) U.S. Cl.
CPC ..... *A24D 1/20* (2020.01); *A24B 15/16* (2013.01); *A24B 15/302* (2013.01); *A24F 40/20* (2020.01)

(58) Field of Classification Search
CPC ..... A24F 40/20; A24D 1/20; A24B 15/12; A24B 15/14; A24B 15/16
See application file for complete search history.

(56) References Cited

U.S. PATENT DOCUMENTS

| | | | | |
|---|---|---|---|---|
| 2007/0074734 | A1* | 4/2007 | Braunshteyn | A24F 13/00 131/194 |
| 2017/0119049 | A1* | 5/2017 | Blandino | A24D 1/042 |
| 2017/0360078 | A1 | 12/2017 | Mishra et al. | |
| 2018/0168232 | A1* | 6/2018 | Reevell | H05B 3/12 |
| 2020/0178591 | A1* | 6/2020 | Frobisher | A24C 5/40 |

(Continued)

FOREIGN PATENT DOCUMENTS

| | | | |
|---|---|---|---|
| JP | 2018531590 | A | 11/2018 |
| JP | 2020517286 | A | 6/2020 |

(Continued)

OTHER PUBLICATIONS

International Search Report and Written Opinion received for PCT Patent Application No. PCT/EP2021/072599, mailed on Nov. 29, 2021, 10 pages.

*Primary Examiner* — Eric Yaary
(74) *Attorney, Agent, or Firm* — WOMBLE BOND DICKINSON (US) LLP

(57) ABSTRACT

An aerosol-generating material including an amorphous solid, wherein the amorphous solid includes: a gelling agent; an aerosol-former material; a flavorant and/or active substance; and a filler; wherein the filler extends only partially through a thickness of the amorphous solid.

11 Claims, 5 Drawing Sheets

(56) References Cited

U.S. PATENT DOCUMENTS

| | | | | |
|---|---|---|---|---|
| 2021/0015144 | A1* | 1/2021 | Capelli | A61K 47/46 |
| 2023/0137057 | A1* | 5/2023 | Dylan-Hyde | A24F 40/20<br>131/194 |

FOREIGN PATENT DOCUMENTS

| | | | | |
|---|---|---|---|---|
| WO | WO-2018197892 | A1 * | 11/2018 | A24B 15/12 |
| WO | 2020/025701 | A1 | 2/2020 | |
| WO | 2020/025722 | A1 | 2/2020 | |
| WO | 2020026309 | A1 | 2/2020 | |

* cited by examiner

AEROSOL GENERATION

PRIORITY CLAIM

The present application is a National Phase entry of PCT Application No. PCT/EP2021/072599, filed Aug. 13, 2021, which claims priority from GB Application No. 2012723.9, filed Aug. 14, 2020, each of which hereby fully incorporated herein by reference.

TECHNICAL FIELD

The present disclosure relates to aerosol-generating materials including an amorphous solid and consumables for use within a non-combustible aerosol provision system, the consumables comprising the aerosol-generating material comprising the amorphous solid; and non-combustible aerosol provision systems.

BACKGROUND

Smoking consumables such as cigarettes, cigars and the like burn tobacco during use to create tobacco smoke. Alternatives to these types of consumables release an inhalable aerosol or vapor by releasing compounds from a substrate material by heating without burning. These may be referred to as non-combustible smoking consumables or aerosol generating assemblies.

One example of such a product is a heating device which releases compounds by heating, but not burning, a solid aerosol-generating material. This solid aerosol-generating material may, in some cases, contain a botanical material. The heating volatilizes at least one component of the material, typically forming an inhalable aerosol. These products may be referred to as heat-not-burn devices, tobacco heating devices or tobacco heating products. Various different arrangements for volatilizing at least one component of the solid aerosol-generating material are known.

As another example, there are hybrid devices. These contain a liquid source (which may or may not contain nicotine) which is vaporized by heating to produce an inhalable vapor or aerosol. The device additionally contains a solid aerosol-generating material (which may or may not contain a tobacco material) and components of this material are entrained in the inhalable vapor or aerosol to produce the inhaled medium.

SUMMARY

According to a first aspect of the present disclosure, there is provided an aerosol-generating material including an amorphous solid, wherein the amorphous solid includes:

- a gelling agent:
- an aerosol-former material:
- flavorant and/or active substance; and
- a filler; wherein the filler extends partially through a thickness of the amorphous solid.

According to a further aspect of the present disclosure, there is a consumable for use within a non-combustible aerosol provision system, the consumable including the aerosol-generating material as defined herein.

According to a further aspect of the present disclosure, therein provided a non-combustible aerosol provision system including the consumable as defined herein and a non-combustible aerosol provision device, the non-combustible aerosol provision device including an aerosol-generation device arranged to generate aerosol from the consumable when the consumable is used with the non-combustible aerosol provision device.

A further aspect of the disclosure provides the use of an aerosol-generating material as defined herein in a consumable for use in a non-combustible aerosol provision device, the non-combustible aerosol provision device including an aerosol-generation device arranged to generate aerosol from the consumable when the consumable is used with the non-combustible aerosol provision device.

Further features and advantages of the disclosure will become apparent from the following description of exemplary embodiments of the disclosure, given by way of example only, which is made with reference to the accompanying drawings.

DETAILED DESCRIPTION

Figure 1:
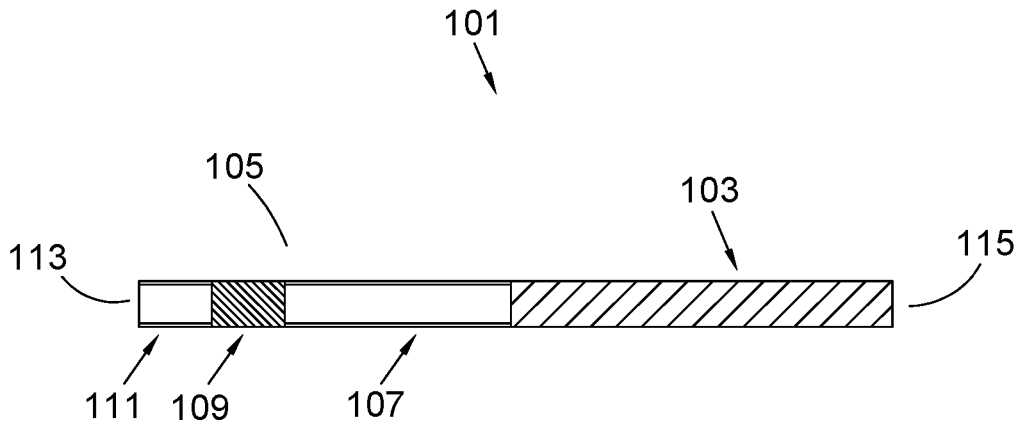
FIG. 1 shows a section view of an example of a consumable.

Suitably the aerosol-generating material of the disclosure is in the form of an aerosol-forming "amorphous solid". The aerosol-forming "amorphous solid" may alternatively be referred to as a "monolithic solid" (i.e. non-fibrous), or as a "dried gel". The amorphous solid is a solid material that may retain some fluid, such as liquid, within it. The amorphous solid forms part of an aerosol-generating material which includes from 50 wt %, 60 wt % or 70 wt % of amorphous solid, to about 90 wt %, 95 wt % or 100 wt % of amorphous solid. In some cases, the aerosol-generating material consists of amorphous solid.

The amorphous solid of the aerosol-generating material described throughout is formed from a dried gel. The inventors have found that using the component proportions described herein means that as the gel sets, flavor compounds are stabilized within the gel matrix allowing a higher flavor loading to be achieved than in non-gel compositions. The flavoring (e.g. menthol) is stabilized at high concentrations and the products have a good shelf life.

In some cases, the amorphous solid includes from 5-50 wt %, 10-40 wt % or 15-30 wt % of the filler. In some such cases the amorphous solid includes at least 1 wt % of the filler, for example, at least 5 wt %, at least 10 wt %, at least 20 wt % at least 30 wt %, at least 40 wt %, or at least 50 wt % of the filler. In exemplary embodiments, the amorphous solid includes 5-25 wt % of the filler.

In some embodiments, the amorphous solid includes less than 60 wt % of the filler, such as from 1 wt % to 60 wt %, or 5 wt % to 50 wt %, or 5 wt % to 30 wt %, or 10 wt % to 20 wt %.

In some embodiments, the amorphous solid includes less than 60 wt % of the filler, such as from 1 wt % to 60 wt %, or 5 wt % to 50 wt %, or 5 wt % to 30 wt %, or 10 wt % to 20 wt %.

In other embodiments, the amorphous solid includes less than 20 wt %, suitably less than 10 wt % of the filler.

The filler may include one or more organic filler materials such as wood pulp, cellulose and cellulose derivatives (such as methylcellulose, hydroxypropyl cellulose, and carboxymethyl cellulose (CMC)).

In particular cases, the amorphous solid includes no inorganic filler material, e.g. the amorphous solid includes no calcium carbonate such as chalk.

Suitably, the filler is fibrous, e.g. the filler is in the form of fibers. For example, the filler may be a fibrous organic filler material such as wood pulp (e.g. wood fibers), hemp fiber, cellulose or cellulose derivatives (such as methylcellulose, hydroxypropyl cellulose, and carboxymethyl cellulose (CMC)).

Without wishing to be bound by theory, it is believed that including fibrous filler in an amorphous solid may increase the tensile strength of the material. Additionally, including a fibrous filler has been found to improve the handling of the amorphous solid during manufacturing.

The inventors of the present application have found that when the filler extends partially through a thickness of the amorphous solid: in other words, when the filler does not penetrate through the full thickness of the amorphous solid, loss of flavorant during storage is reduced. Without wishing to be bound by theory, it is thought that using a filler in this way could reduce wicking of the flavorant by the filler toward the surface of the amorphous solid, where it may be lost by evaporation.

There are numerous means by which wicking of the flavorant may be reduced: however, it has been found by the present inventors that when a fibrous filler is used wicking may be reduced if the fibers extend only partially through a thickness of the amorphous solid: i.e. the fibers do not span the full thickness of the amorphous solid (such as in the case of short fibers). Thus, in some embodiments fibers are suitably added to the amorphous solid such that the fibers do not span the full thickness of the amorphous solid. Whilst short fibers may be used, an alternative strategy for reducing flavorant loss through wicking, is to include a mat of the fibers (i.e. a woven or non-woven sheet of fibers) which does not penetrate through the full thickness of the amorphous solid. The effect may also be achieved by including a porous layer within the amorphous solid, which can provide similar tensile strength to the fibers, whilst reducing wicking.

When used herein the terms "a filler" and "the filler" can encompass both "all filler particles" and "each filler particle" contained in the amorphous solid. For example, when the filler includes fibers "the fibers" may encompass both "all fibers" and "each fiber", unless the context of the term requires that "the fibers" should be interpreted as "all fibers". Thus, when stating that "the fibers extend through less than 90% of the thickness of the amorphous solid", this can mean both that each fiber extends through less than 90% of the thickness of the amorphous solid and also that all of the fibers extend through less than 90% of the thickness of the amorphous solid.

In some embodiments the amorphous solid is in the form of a sheet. In some of these embodiments the sheet includes at least: a first layer including a first portion of the amorphous solid, wherein the first portion includes from 0 to 25 wt % of the filler present in the amorphous solid; and a second layer including a second portion of the amorphous solid, wherein the second portion includes at least 75 wt % of the filler present in the amorphous solid. In some such embodiments the first portion includes a first planar surface and the second portion includes a second planar surface opposed to the first planar surface, wherein the filler is exposed at no more than one of the first planar surface and second planar surface of the amorphous solid. In such embodiments, loss of the flavorant is reduced during storage because the flavorant is more likely to evaporate from only a single planar surface of the amorphous solid.

The amorphous solid extends through a first dimension, second dimension, and third dimension. In examples, the amorphous solid is provided as a sheet having a length, a width, and a thickness. Typically, the length and width of a sheet of amorphous solid are each significantly greater than its thickness (e.g. has a significantly greater extension in the first and second dimension than the third dimension).

As used herein, a "planar surface" typically refers to a surface which extends along the first and second dimension of the amorphous solid (e.g. along its length and thickness). In examples, the planar surface refers to the top face or bottom face of a sheet. Although other surfaces of the amorphous solid may be flat (e.g. a surface extending along the third dimension (thickness) connecting the top and bottom faces of a sheet of amorphous solid), they are not considered to be "planar surfaces" as used herein.

In some embodiments the amorphous solid includes two or more planar layers of amorphous solid, wherein a first layer includes from 0 to 25 wt % of the filler present in the amorphous solid; and wherein a second layer includes at least 75 wt % of the filler present in the amorphous solid. In some embodiments the amorphous solid includes three layers, wherein a first layer includes from 0 to 15 wt % of the filler present in the amorphous solid: a second layer includes at least 70 wt % of the filler present in the amorphous solid; and a third layer includes from 0 to 15 wt % of the filler present in the amorphous solid, wherein the second layer is disposed between the first layer and the third layer. In some such embodiments, the first and third layers include outer planar surfaces which are opposed to each other (as in a sheet), and the second layer lies between the first and third layers. Using such an arrangement in the amorphous solid reduces the surface area of the amorphous solid over which the filler is exposed to the atmosphere. It is thought that doing this reduces loss of flavorant due to evaporation from the surface of the amorphous solid.

In some embodiments when the filler includes fibers: the fibers are not exposed to the atmosphere at any planar surface of the amorphous solid. In some embodiments, the amorphous solid is in sheet form and includes fibers which are shorter in length than the thickness of the amorphous solid sheet. In some embodiments at least about 10 wt %, 20 wt %, 30 wt %, 40 wt % or 50 wt % (dry weight basis) of the fibers in the amorphous solid sheet have a length that is shorter than the thickness of the amorphous solid sheet. In some embodiments 10-40 wt % or 50-100 wt % (dry weight basis) of the fibers in the amorphous solid sheet have a length that is shorter than the thickness of the amorphous solid sheet. For example, in some embodiments the fibers or each fiber extends through less than 90% of the thickness of the amorphous solid (e.g. amorphous solid sheet). In some embodiments, all the fibers are dispersed throughout the full thickness of the amorphous solid.

In embodiments where the fibers are arranged as a woven or non-woven sheet, suitably the woven or non-woven sheet is exposed at no more than one planar surface of the amorphous solid (e.g. amorphous solid sheet). However, in other embodiments, the woven or non-woven sheet of fibers is not exposed at any planar surface of the amorphous solid (e.g. amorphous solid sheet). In embodiments where the amorphous solid includes two or more planar layers of amorphous solid, no more than one layer includes the woven or non-woven sheet of fibers. In embodiments where the amorphous solid includes three layers, no more than one layer includes the woven or non-woven sheet of fibers. In some of these embodiments the second layer (between the first and third layers) includes the woven or non-woven sheet of fibers. Such an arrangement minimizes the surface area of the amorphous solid over which the fibers are exposed. Without wishing to be bound by theory, it is thought that using such an arrangement could reduce wicking of the flavorant to the surface of the amorphous solid compared to when fibers span the full width of the amorphous solid: when such fibers wick flavorant to the surface of the amorphous solid the flavorant may be lost by evaporation. Hence, using a woven or non-woven sheet of fibers in this way provides stability and tensile strength to the amorphous solid, whilst reducing loss of flavorant during storage.

In some embodiments, the filler is provided as a porous layer, wherein the porous layer is exposed at only one planar surface of the amorphous solid (e.g. amorphous solid sheet). In other embodiments the porous layer is not exposed at any planar surface of the amorphous solid. In embodiments where the amorphous solid includes two or more planar layers of amorphous solid, no more than one layer includes the porous layer. In embodiments where the amorphous solid includes three layers, no more than one layer includes the porous layer. In some of these embodiments the second layer (between the first and third layers) includes the porous layer. Such an arrangement minimizes the surface area of the amorphous solid over which the filler is exposed. Without wishing to be bound by theory, it is thought that using such a porous layer could reduce wicking of the flavorant to the surface of the amorphous solid compared to when fibers span the full width of the amorphous solid: when such fibers wick flavorant to the surface of the amorphous solid the flavorant may be lost by evaporation. Hence, using such a porous layer provides stability and tensile strength to the amorphous solid, whilst reducing loss of flavorant during storage.

In some embodiments, when the filler is provided as a porous layer, the porous layer includes paper, polymeric fibers, open cell foam, ceramic and/or zeolites. The polymeric fibers may, in some cases, may be woven or knitted. Suitable polymeric fibers include, without limitation, polypropylene, low density polyethylene, polyethylene terephthalate, polyurethane, polyvinyl acetate, polyvinyl alcohol, styrene, ethyl vinyl acetate, rayon, silk, cotton, polyester, cellulosic materials such as hydroxypropyl cellulose and combinations thereof. In some cases, the polymeric fibers can include pigmented or dyed polymers. In some cases, reconstituted cellulosic fibers (e.g., derived from tobacco plant tissue) can be used. In some cases, the porous layer is selected from the group consisting of open cell foam, polymeric fibers and paper.

In some embodiments, the filler added to the amorphous solid may include or consist of a material which exhibits reduced wicking characteristics compared with wood fibers or wood pulp. Such fibers may include or consist of a non-porous material. One class of non-porous materials which could be used is synthetic polymeric fibers, such as plastics. Other fillers with reduced wicking characteristics which could be used in place of wood fibers include particulate cork, extruded fibers, e.g. ceramic fibers, plastic/polymeric fibers, HPMC (hydroxypropyl methylcellulose), cellulose nanofibers, microcrystalline cellulose, glass fibers or fibers made from amorphous materials could also be used in place of wood fibers to reduce loss of flavorant during storage. Wood fibers having high lignin content could also be used to reduce loss of flavorant during storage.

The "thickness" of the amorphous solid describes the shortest distance between a first surface and a second surface. In embodiments where the amorphous solid is in the form of a sheet, the thickness of the amorphous solid is the shortest distance between a first planar surface of the sheet and a second planar surface of the sheet which opposes the first planar surface of the sheet. In some cases, the aerosol-generating material may have a thickness of about 0.015 mm to about 1.0 mm. Suitably, the thickness may be in the range of about 0.05 mm, 0.1 mm or 0.15 mm to about 0.5 mm or 0.3 mm. The amorphous solid may include more than one layer, and the thickness described herein refers to the aggregate thickness of those layers.

In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The amorphous solid may include more than one layer, and the thickness described herein refers to the aggregate thickness of those layers.

The inventors have established that if the aerosol-generating material or amorphous solid is too thick, then heating efficiency is compromised. This adversely affects the power consumption in use. Conversely, if the aerosol-generating material or amorphous solid is too thin, it is difficult to manufacture and handle: a very thin material is harder to cast and may be fragile, compromising aerosol formation in use.

The inventors have established that the aerosol-generating material thicknesses stipulated herein optimize the material properties in view of these competing considerations.

The thickness stipulated herein is a mean thickness for the material. In some cases, the amorphous solid thickness may vary by no more than 25%, 20%, 15%, 10%, 5% or 1%.

In some examples, the amorphous solid in sheet form may have a tensile strength of from around 200 N/m to around 2600 N/m. In some examples, the amorphous solid may have a tensile strength of from 600 N/m to 2000 N/m, or from 700 N/m to 1500 N/m, or around 1000 N/m. Such tensile strengths may be particularly suitable for embodiments wherein the aerosol-generating material including the amorphous solid is formed and incorporated into an aerosol-generating consumable as a sheet.

Suitably, the amorphous solid may include from about 1 wt %, 5 wt %, 10 wt %, 15 wt %, 20 wt % or 25 wt % to about 60 wt %, 50 wt %, 45 wt %, 40 wt % or 35 wt % of a gelling agent (all calculated on a dry weight basis). For example, the amorphous solid may include 1-50 wt %, 5-45 wt %, 10-40 wt % or 20-35 wt % of a gelling agent. In exemplary embodiment, the amorphous solid includes from about 20 wt % 22 wt %, 24 wt % or 25 wt % to about 30 wt %, 32 wt % or 35 wt % of a gelling agent (all calculated on a dry weight basis). For example, the amorphous solid may include 20-35 wt % or 25-30 wt % of a gelling agent.

In some embodiments, the gelling agent includes one or more compounds selected from the group including alginates, pectins, starches (and derivatives), celluloses (and derivatives), gums, silica or silicones compounds, clays, polyvinyl alcohol and combinations thereof. For example, in some embodiments, the gelling agent includes one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent includes alginate and/or pectin, and may be combined with a setting agent (such as a calcium source) during formation of the amorphous solid. In some cases, the amorphous solid may include a calcium-crosslinked alginate and/or a calcium-crosslinked pectin.

In some embodiments, the gelling agent includes alginate, and the alginate is present in the amorphous solid in an amount of from 10-30%, 20-35 wt % or 25-30 wt % of the amorphous solid (calculated on a dry weight basis). In some embodiments, alginate is the only gelling agent present in the amorphous solid. In other embodiments, the gelling agent includes alginate and at least one further gelling agent, such as pectin.

In some embodiments, the amorphous solid may include gelling agent including carrageenan.

The inclusion of a gelling agent in a slurry to form an amorphous solid results in the aerosol-generating material being formed from a dried gel. The inventors have found that by including a gel in the aerosol-generating material, flavorant compounds, for example, menthol, are stabilized within the gel matrix allowing controlled release of flavorant over the course of a smoking session. The flavoring (e.g. menthol) is stabilized at high concentrations and the products have a good shelf life.

Suitably, the amorphous solid includes about 0.1 wt %, 0.5 wt %, 1 wt %, 3 wt %, 5 wt %, 7 wt % or 10% to about 50 wt %, 45 wt %, 40 wt %, 35 wt %, 30 wt % or 25 wt % of an aerosol-former material (all calculated on a dry weight basis). In exemplary embodiments, the amorphous solid includes from 10-25% of an aerosol-former material. The aerosol-former material may act as a plasticizer. In some cases, the aerosol-former material includes one or more compound selected from erythritol, propylene glycol, glycerol, triacetin, sorbitol and xylitol. In some cases, the aerosol-former material includes, consists essentially of or consists of glycerol. The inventors have established that if the content of the plasticizer is too high, the amorphous solid may absorb water resulting in a material that does not create an appropriate consumption experience in use. The inventors have established that if the plasticizer content is too low, the amorphous solid may be brittle and easily broken. The plasticizer content specified herein provides an amorphous solid flexibility which allows the sheet to be wound onto a bobbin, which is useful in manufacture of consumables.

Suitably, the amorphous solid includes up to about 80 wt %, 70 wt %, 60 wt %, 55 wt %, 50 wt % or 45 wt % of flavorant. In some cases, the amorphous solid may include at least about 0.1 wt %, 1 wt %, 10 wt %, 20 wt %, 30 wt %, 35 wt % or 40 wt % of flavorant (all calculated on a dry weight basis). For example, the amorphous solid may include 1-80 wt %, 10-80 wt %, 20-70 wt %, 30-60 wt %, 35-55 wt % or 30-45 wt % of flavorant. In exemplary embodiments, the amorphous solid includes 35-50 wt % of flavorant. In some cases, the flavorant includes, consists essentially of or consists of menthol.

In some cases, the amorphous solid may additionally include an emulsifying agent, which emulsifies flavorant during manufacture. For example, the amorphous solid may include from about 5 wt % to about 15 wt % of an emulsifying agent (calculated on a dry weight basis), suitably about 10 wt %. The emulsifying agent may include acacia gum.

In some embodiments, the amorphous solid is a hydrogel and includes less than about 20 wt % of water calculated on a wet weight basis. In some cases, the hydrogel may include less than about 15 wt %, 12 wt % or 10 wt % of water calculated on a wet weight basis. In some cases, the hydrogel may include at least about 1 wt %, 2 wt % or at least about 5 wt % of water (WWB).

In some embodiments, the amorphous solid additionally includes an active substance. For example, in some cases, the amorphous solid additionally includes a tobacco material and/or nicotine. In some cases, the amorphous solid may include 5-60 wt % (calculated on a dry weight basis) of a tobacco material and/or nicotine. In some cases, the amorphous solid may include from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of an active substance. In some cases, the amorphous solid may include from about 1 wt %, 5 wt %, 10 wt %, 15 wt %, 20 wt % or 25 wt % to about 70 wt %, 60 wt %, 50 wt %, 45 wt %, 40 wt %, 35 wt %, or 30 wt % (calculated on a dry weight basis) of a tobacco material. For example, the amorphous solid may include 10-50 wt %, 15-40 wt % or 20-35 wt % of a tobacco material. In some cases, the amorphous solid may include from about 1 wt %, 2 wt %, 3 wt % or 4 wt % to about 20 wt %, 18 wt %, 15 wt % or 12 wt % (calculated on a dry weight basis) of nicotine. For example, the amorphous solid may include 1-20 wt %, 2-18 wt % or 3-12 wt % of nicotine.

In some cases, the amorphous solid includes an active substance such as tobacco extract. In some cases, the amorphous solid may include 5-60 wt % (calculated on a dry weight basis) of tobacco extract. In some cases, the amorphous solid may include from about 5 wt %, 10 wt %, 15 wt %, 20 wt % or 25 wt % to about 60 wt %, 50 wt %, 45 wt %, 40 wt %, 35 wt %, or 30 wt % (calculated on a dry weight basis) tobacco extract. For example, the amorphous solid may include 10-50 wt %, 15-40 wt % or 20-35 wt % of tobacco extract. The tobacco extract may contain nicotine at a concentration such that the amorphous solid includes 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the amorphous solid other than that which results from the tobacco extract.

In some embodiments the amorphous solid includes no tobacco material but does include nicotine. In some such cases, the amorphous solid may include from about 1 wt %, 2 wt %, 3 wt % or 4 wt % to about 20 wt %, 18 wt %, 15 wt % or 12 wt % (calculated on a dry weight basis) of nicotine. For example, the amorphous solid may include 1-20 wt %, 2-18 wt % or 3-12 wt % of nicotine.

In some cases, the total content of flavorant may be at least about 0.1 wt %, 1 wt %, 5 wt %, 10 wt %, 20 wt %, 25 wt % or 30 wt %. In some cases, the total content of active substance and/or flavorant may be less than about 90 wt %, 80 wt %, 70 wt %, 60 wt %, 50 wt % or 40 wt % (all calculated on a dry weight basis). In exemplary embodiments, the flavorant is menthol.

The amorphous solid may be made from a gel, and this gel may additionally include a solvent, included at 0.1-50 wt %. However, the inventors have established that the inclusion of a solvent in which the flavorant is soluble may reduce the gel stability and the flavorant may crystallize out of the gel. As such, in some cases, the gel does not include a solvent in which the flavorant is soluble.

In exemplary embodiments, the amorphous solid includes 20-35 wt % of the gelling agent: 10-25 wt % of the aerosol-former material: 5-25 wt % of the filler including fibers; and 35-50 wt % of the flavorant and/or active substance.

In some cases, the amorphous solid may consist essentially of, or consist of a gelling agent, water, an aerosol-former material, a flavor, and optionally an active substance.

In some cases, the amorphous solid may consist essentially of, or consist of a gelling agent, water, an aerosol-former material, a flavor, and optionally a tobacco material and/or a nicotine source.

The inventors have established that if the amorphous solid is too thick, then heating efficiency is compromised. This adversely affects the power consumption in use. Conversely, if the amorphous solid is too thin, it is difficult to manufacture and handle: a very thin material is harder to cast and may be fragile, compromising aerosol formation in use. The inventors have established that the amorphous solid thicknesses stipulated herein optimize the material properties in view of these competing considerations.

The thickness values stipulated herein are mean values for the thickness in question. In some cases, the thickness may vary by no more than 25%, 20%, 15%, 10%, 5% or 1%.

The aerosol-generating material including the amorphous solid may have any suitable area density, such as from 30 $g/m^2$ to 120 $g/m^2$. In some cases, the sheet may have a mass per unit area of 80-120 $g/m^2$, or from about 70 to 110 $g/m^2$, or particularly from about 90 to 110 $g/m^2$, or suitably about 100 $g/m^2$ (so that it has a similar density to cut rag tobacco and a mixture of these substances will not readily separate). Such area densities may be particularly suitable where the aerosol-generating material is included in a consumable/assembly as a shredded sheet (described further hereinbelow). In some cases, the sheet may have a mass per unit area of about 30 to 70 $g/m^2$, 40 to 60 $g/m^2$, or 25-60 $g/m^2$.

In some embodiments, consumables include an aerosol-generating material as described herein, wherein the aerosol-generating material is in the form of shreds. In such embodiments, the aerosol-generating material may be formed from a sheet of the amorphous solid which has been shredded. In exemplary consumables, the aerosol-generating material includes shredded amorphous solid mixed with a shredded tobacco material. In some examples where the tobacco material is fine cut and the amorphous solid is a shredded sheet, the cut width of the amorphous solid is from about 90 to 110% of the cut width of the tobacco material. That is, the amorphous solid and the tobacco material have similar cut widths, or shred widths. The inventors have identified that configuring the amorphous solid and tobacco material to have similar cut widths allows for better blending of the amorphous solid and tobacco material. For example, shredded amorphous solid sheet and cut rag tobacco which have similar cut widths can be blended to provide a more homogenous aerosol-generating composition (e.g. better distribution of each component throughout the aerosol-generating composition).

Consumable and Non-Combustible Aerosol Provision System

As used herein, the term "delivery system" is intended to encompass systems that deliver a substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials:
- consumables including aerosol-generating material and configured to be used within one of these non-combustible aerosol provision systems; and
- aerosol-free delivery systems which deliver one or more substances to a user orally, nasally, transdermally or in another way without forming an aerosol, including but not limited to, lozenges, gums, patches, consumables including inhalable powders, and oral products such as oral tobacco which includes snus or moist snuff, wherein the substance may or may not include nicotine.

According to the present disclosure, a "combustible" aerosol provision system is one where a constituent aerosol-generating material of the aerosol provision system (or component thereof) is combusted or burned during use in order to facilitate delivery to a user.

According to the present disclosure, a "non-combustible" aerosol provision system is one where a constituent aerosol-generating material of the aerosol provision system (or component thereof) is not combusted or burned in order to facilitate delivery to a user.

In some embodiments, the delivery system is a combustible aerosol provision system, selected from the group consisting of a cigarette, a cigarillo and a cigar.

In some embodiments, the disclosure relates to a component for use in a combustible aerosol provision systems, such as a filter, a filter rod, a filter segment, a tobacco rod, a spill, an additive release component such as a capsule, a thread, or a bead, or a paper such as a plug wrap, a tipping paper or a cigarette paper.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is a tobacco heating system, also known as a heat-not-burn system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system includes a liquid or gel aerosol-generating material and a solid aerosol-generating material. The solid aerosol-generating material may include, for example, tobacco or a non-tobacco product.

Typically, the non-combustible aerosol provision system may include a non-combustible aerosol provision device and a consumable for use with the non-combustible aerosol provision device. However, it is envisaged that consumables which themselves include a means for powering an aerosol generating component may themselves form the non-combustible aerosol provision system.

In some embodiments, the non-combustible aerosol provision device may include a power source and a controller. The power source may, for example, be an electric power source or an exothermic power source. In some embodiments, the exothermic power source includes a carbon substrate which may be energized so as to distribute power in the form of heat to an aerosol-generating material or heat transfer material in proximity to the exothermic power source. In some embodiments, the power source, such as an exothermic power source, is provided in the consumable so as to form the non-combustible aerosol provision.

In some embodiments, the consumable for use with the non-combustible aerosol provision device may include an aerosol-generating material, an aerosol generating component, an aerosol generating area, a mouthpiece, and/or an area for receiving aerosol-generating material.

In some embodiments, the aerosol generating component is a heater capable of interacting with the aerosol-generating material so as to release one or more volatiles from the aerosol-generating material to form an aerosol. In some embodiments, the aerosol generating component is capable of generating an aerosol from the aerosol-generating material without heating. For example, the aerosol generating component may be capable of generating an aerosol from the aerosol-generating material without applying heat thereto, for example via one or more of vibrational, mechanical, pressurization or electrostatic means.

The consumable may alternatively be referred to herein as a cartridge. The consumable may be adapted for use in a THP, a hybrid device or another aerosol generating device. In some cases, the consumable may additionally include a filter and/or cooling element, as described previously. In some cases, the consumable may be circumscribed by a wrapping material such as paper.

The consumable may additionally include ventilation apertures. These may be provided in the sidewall of the consumable. In some cases, the ventilation apertures may be provided in the filter and/or cooling element. These apertures may allow cool air to be drawn into the consumable during use, which can mix with the heated volatilized components thereby cooling the aerosol.

The ventilation enhances the generation of visible heated volatilized components from the consumable when it is heated in use. The heated volatilized components are made visible by the process of cooling the heated volatilized components such that supersaturation of the heated volatilized components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

Figure 2:
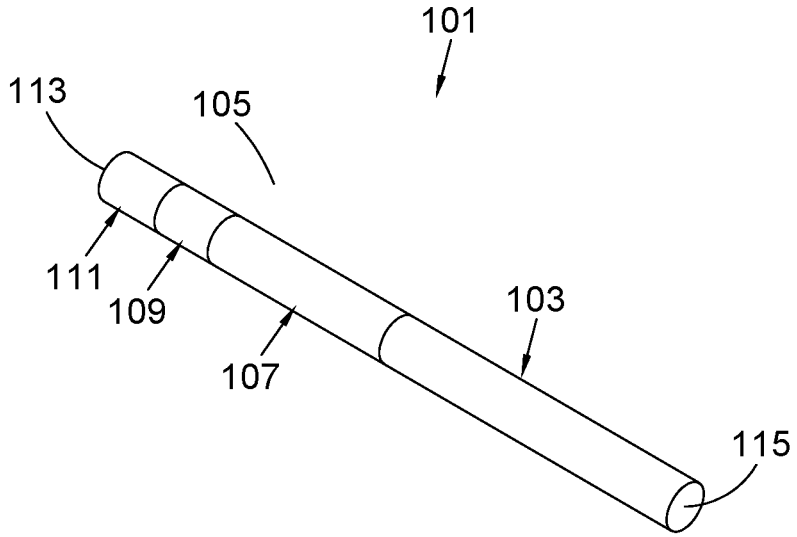
FIG. 2 shows a perspective view of the consumable of FIG. 1.

Referring to FIGS. 1 and 2, there are shown a partially cut-away section view and a perspective view of an example of an aerosol-generating consumable 101. The consumable 101 is adapted for use with a device having a power source and a heater. The consumable 101 of this embodiment is particularly suitable for use with the device 51 shown in FIGS. 5 to 7, described below. In use, the consumable 101 may be removably inserted into the device shown in FIG. 5 at an insertion point 20 of the device 51.

The consumable 101 of one example is in the form of a substantially cylindrical rod that includes a body of aerosol-generating material 103 and a filter assembly 105 in the form of a rod. The aerosol-generating material includes the amorphous solid material described herein. In some embodiments, it may be included in sheet form. In some embodiments it may be included in the form of a shredded sheet. In some embodiments, the aerosol-generating material described herein may be incorporated in sheet form and in shredded form. In some embodiments, the aerosol-generating material provided in the consumable may include a blend of shredded amorphous solid and tobacco.

The filter assembly 105 includes three segments, a cooling segment 107, a filter segment 109 and a mouth end segment 111. The consumable 101 has a first end 113, also known as a mouth end or a proximal end and a second end 115, also known as a distal end. The body of aerosol-generating material 103 is located towards the distal end 115 of the consumable 101. In one example, the cooling segment 107 is located adjacent the body of aerosol-generating material 103 between the body of aerosol generating material 103 and the filter segment 109, such that the cooling segment 107 is in an abutting relationship with the aerosol-generating material 103 and the filter segment 103. In other examples, there may be a separation between the body of aerosol-generating material 103 and the cooling segment 107 and between the body of aerosol-generating material 103 and the filter segment 109. The filter segment 109 is located in between the cooling segment 107 and the mouth end segment 111. The mouth end segment 111 is located towards the proximal end 113 of the consumable 101, adjacent the filter segment 109. In one example, the filter segment 109 is in an abutting relationship with the mouth end segment 111. In one embodiment, the total length of the filter assembly 105 is between 37 mm and 45 mm, for example, the total length of the filter assembly 105 is 41 mm.

In one example, the rod of aerosol-generating material 103 is between 34 mm and 50 mm in length, suitably between 38 mm and 46 mm in length, suitably 42 mm in length.

In one example, the total length of the consumable 101 is between 25 mm and 95 mm, suitably between 79 mm and 87 mm, suitably 83 mm. In another example the total length of the consumable is between 25 mm and 40 mm, suitably between 25 and 35 mm.

An axial end of the body of aerosol-generating material 103 is visible at the distal end 115 of the consumable 101. However, in other embodiments, the distal end 115 of the consumable 101 may include an end member (not shown) covering the axial end of the body of aerosol-generating material 103.

The body of aerosol-generating material 103 is joined to the filter assembly 105 by annular tipping paper (not shown), which is located substantially around the circumference of the filter assembly 105 to surround the filter assembly 105 and extends partially along the length of the body of aerosol-generating material 103. In one example, the tipping paper is made of 58GSM standard tipping base paper. In one example the tipping paper has a length of between 42 mm and 50 mm, suitably of 46 mm.

In one example, the cooling segment 107 is an annular tube and is located around and defines an air gap within the cooling segment. The air gap provides a chamber for heated volatilized components generated from the body of aerosol-generating material 103 to flow. The cooling segment 107 is hollow to provide a chamber for aerosol accumulation yet rigid enough to withstand axial compressive forces and bending moments that might arise during manufacture and whilst the consumable 101 is in use during insertion into the device 51. In one example, the thickness of the wall of the cooling segment 107 is approximately 0.29 mm.

The cooling segment 107 provides a physical displacement between the aerosol-generating material 103 and the filter segment 109. The physical displacement provided by the cooling segment 107 will provide a thermal gradient across the length of the cooling segment 107. In one example the cooling segment 107 is configured to provide a temperature differential of at least 40 degrees Celsius between a heated volatilized component entering a first end of the cooling segment 107 and a heated volatilized component exiting a second end of the cooling segment 107. In one example the cooling segment 107 is configured to provide a temperature differential of at least 60 degrees Celsius between a heated volatilized component entering a first end of the cooling segment 107 and a heated volatilized component exiting a second end of the cooling segment 107. This temperature differential across the length of the cooling element 107 protects the temperature sensitive filter segment 109 from the high temperatures of the aerosol-generating material 103 when it is heated by the device 51. If the physical displacement was not provided between the filter segment 109 and the body of aerosol-generating material 103 and the heating elements of the device 51, then the temperature sensitive filter segment may 109 become damaged in use, so it would not perform its required functions as effectively.

In one example the length of the cooling segment 107 is at least 15 mm. In one example, the length of the cooling segment 107 is between 20 mm and 30 mm, more particularly 23 mm to 27 mm, more particularly 25 mm to 27 mm, suitably 25 mm.

The cooling segment 107 is made of paper, which means that it includes a material that does not generate compounds of concern, for example, toxic compounds when in use adjacent to the heater of the device 51. In one example, the cooling segment 107 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 107 is a recess created from stiff plug wrap or tipping paper. The stiff plug wrap or tipping paper is manufactured to have a rigidity that is sufficient to withstand the axial compressive forces and bending moments that might arise during manufacture and whilst the consumable 101 is in use during insertion into the device 51.

The filter segment 109 may be formed of any filter material sufficient to remove one or more volatilized compounds from heated volatilized components from the aerosol-generating material. In one example the filter segment 109 is made of a mono-acetate material, such as cellulose acetate. The filter segment 109 provides cooling and irritation-reduction from the heated volatilized components without depleting the quantity of the heated volatilized components to an unsatisfactory level for a user.

In some embodiments, a capsule (not illustrated) may be provided in filter segment 109. It may be disposed substantially centrally in the filter segment 109, both across the filter segment 109 diameter and along the filter segment 109 length. In other cases, it may be offset in one or more dimension. The capsule may in some cases, where present, contain a volatile component such as a flavorant or aerosol generating agent.

The density of the cellulose acetate tow material of the filter segment 109 controls the pressure drop across the filter segment 109, which in turn controls the draw resistance of the consumable 101. Therefore, the selection of the material of the filter segment 109 is important in controlling the resistance to draw of the consumable 101. In addition, the filter segment performs a filtration function in the consumable 101.

In one example, the filter segment 109 is made of a 8Y15 grade of filter tow material, which provides a filtration effect on the heated volatilized material, whilst also reducing the size of condensed aerosol droplets which result from the heated volatilized material.

The presence of the filter segment 109 provides an insulating effect by providing further cooling to the heated volatilized components that exit the cooling segment 107. This further cooling effect reduces the contact temperature of the user's lips on the surface of the filter segment 109.

In one example, the filter segment 109 is between 6 mm to 10 mm in length, suitably 8 mm.

The mouth end segment 111 is an annular tube and is located around and defines an air gap within the mouth end segment 111. The air gap provides a chamber for heated volatilized components that flow from the filter segment 109. The mouth end segment 111 is hollow to provide a chamber for aerosol accumulation yet rigid enough to withstand axial compressive forces and bending moments that might arise during manufacture and whilst the consumable is in use during insertion into the device 51. In one example, the thickness of the wall of the mouth end segment 111 is approximately 0.29 mm. In one example, the length of the mouth end segment 111 is between 6 mm to 10 mm, suitably 8 mm.

The mouth end segment 111 may be manufactured from a spirally wound paper tube which provides a hollow internal chamber yet maintains critical mechanical rigidity. Spirally wound paper tubes are able to meet the tight dimensional accuracy requirements of high-speed manufacturing processes with respect to tube length, outer diameter, roundness and straightness.

The mouth end segment 111 provides the function of preventing any liquid condensate that accumulates at the exit of the filter segment 109 from coming into direct contact with a user.

It should be appreciated that, in one example, the mouth end segment 111 and the cooling segment 107 may be formed of a single tube and the filter segment 109 is located within that tube separating the mouth end segment 111 and the cooling segment 107.

Figure 3:
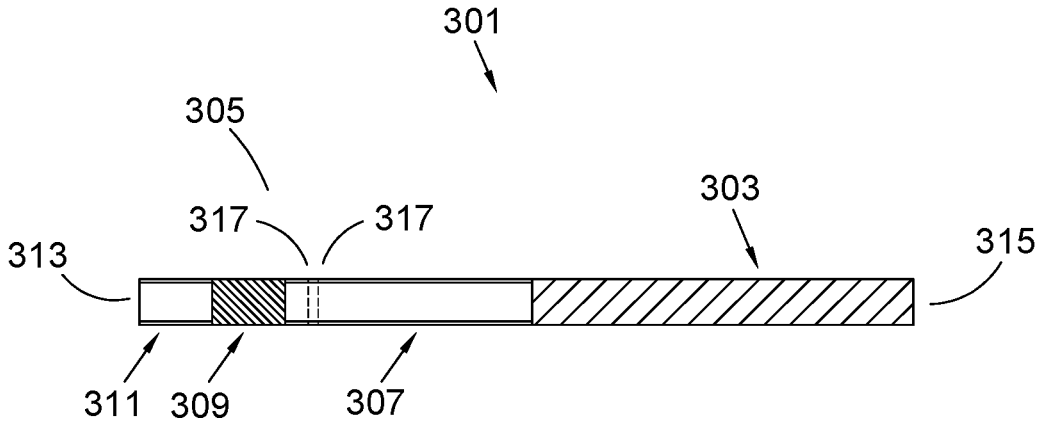
FIG. 3 shows a sectional elevation of an example of a consumable.
Figure 4:
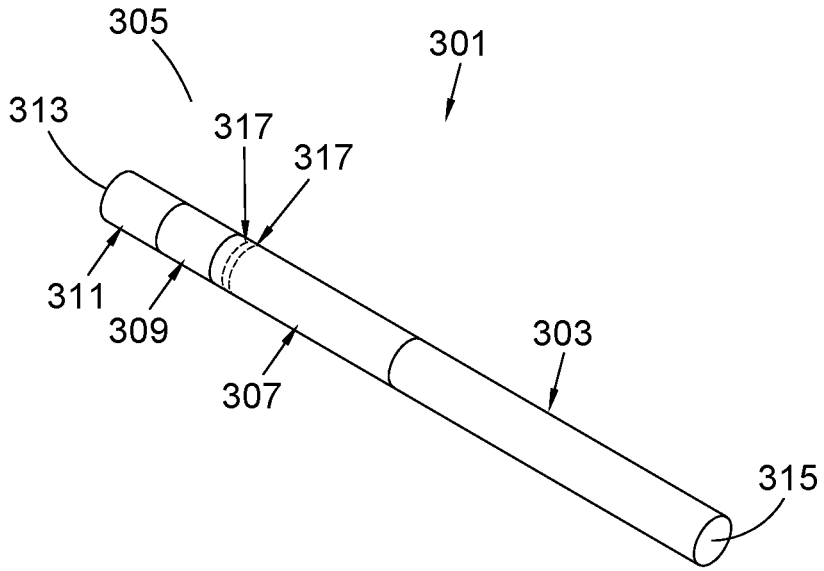
FIG. 4 shows a perspective view of the consumable of FIG. 3.

Referring to FIGS. 3 and 4, there are shown a partially cut-away section and perspective views of an example of an consumable 301. The reference signs shown in FIGS. 3 and 4 are equivalent to the reference signs shown in FIGS. 1 and 2, but with an increment of 200.

In the example of the consumable 301 shown in FIGS. 3 and 4, a ventilation region 317 is provided in the consumable 301 to enable air to flow into the interior of the consumable 301 from the exterior of the consumable 301. In one example the ventilation region 317 takes the form of one or more ventilation holes 317 formed through the outer layer of the consumable 301. The ventilation holes may be located in the cooling segment 307 to aid with the cooling of the consumable 301. In one example, the ventilation region 317 includes one or more rows of holes, for example, each row of holes is arranged circumferentially around the consumable 301 in a cross-section that is substantially perpendicular to a longitudinal axis of the consumable 301.

In one example, there are between one to four rows of ventilation holes to provide ventilation for the consumable 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the consumable 301. The ventilation holes 317 are positioned so as to provide effective cooling to the consumable 301.

In one example, the rows of ventilation holes 317 are located at least 11 mm from the proximal end 313 of the consumable, suitably between 17 mm and 20 mm from the proximal end 313 of the consumable 301. The location of the ventilation holes 317 is positioned such that user does not block the ventilation holes 317 when the consumable 301 is in use.

Figure 6:
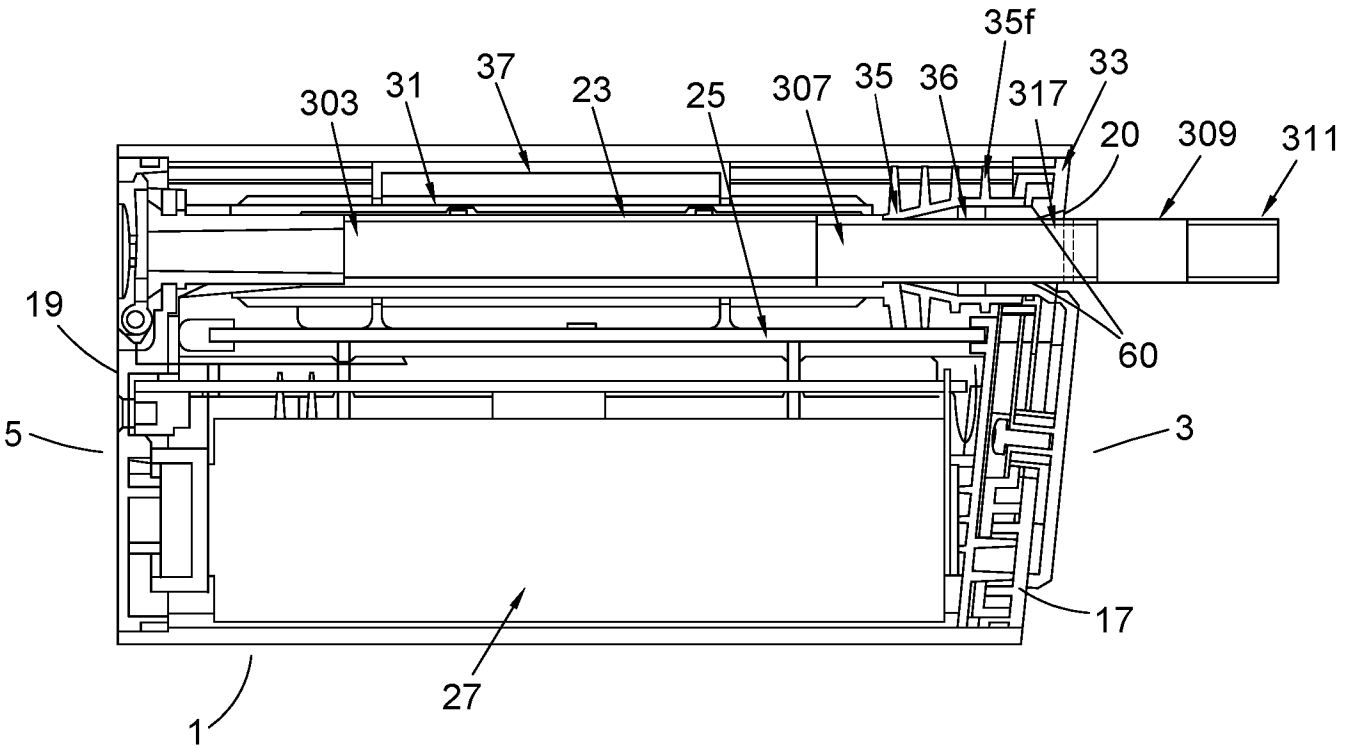
FIG. 6 shows a section view of an example of a non-combustible aerosol provision system.
Figure 7:
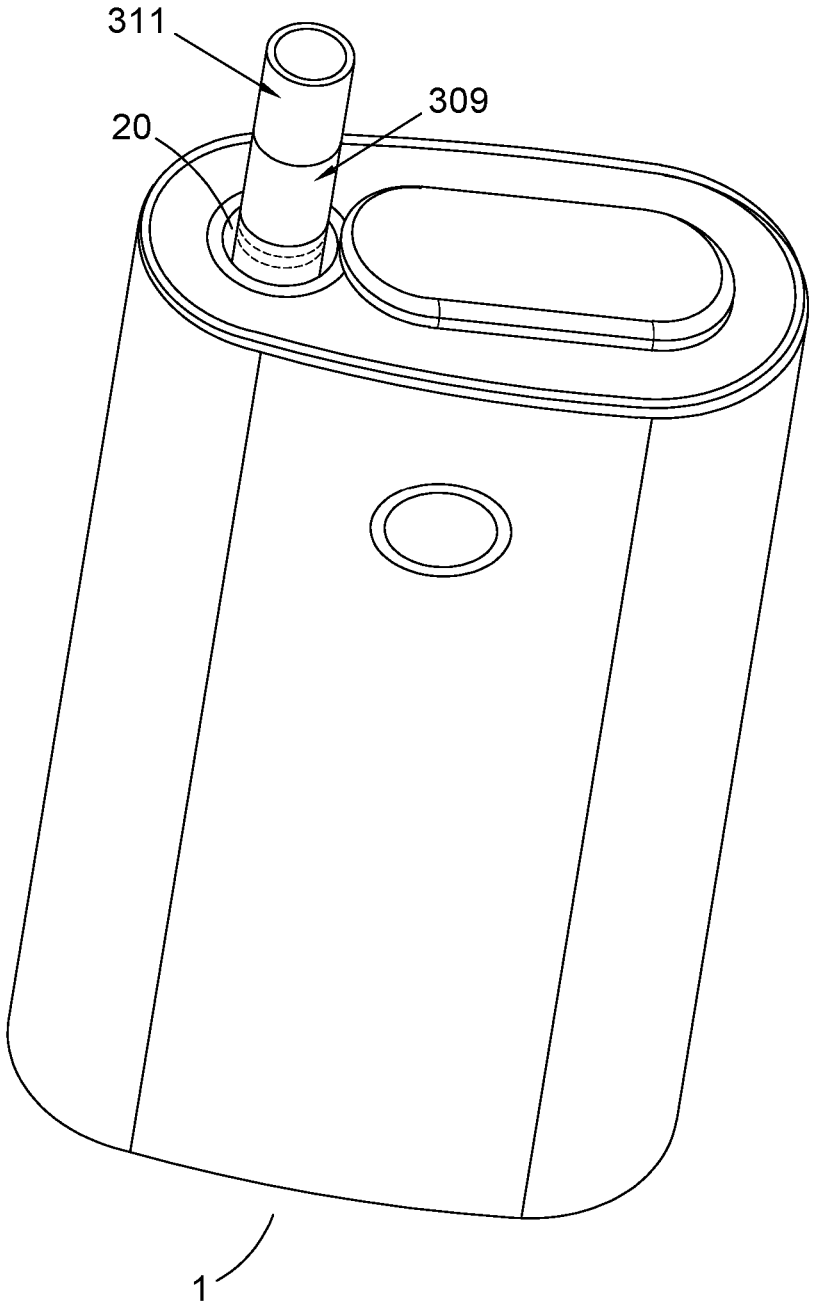
FIG. 7 shows a perspective view of an example of a non-combustible aerosol provision system.

Providing the rows of ventilation holes between 17 mm and 20 mm from the proximal end 313 of the consumable 301 enables the ventilation holes 317 to be located outside of the device 51, when the consumable 301 is fully inserted in the device 51, as can be seen in FIGS. 6 and 7. By locating the ventilation holes outside of the device, non-heated air is able to enter the consumable 301 through the ventilation holes from outside the device 51 to aid with the cooling of the consumable 301.

The length of the cooling segment 307 is such that the cooling segment 307 will be partially inserted into the device 51, when the consumable 301 is fully inserted into the device 51. The length of the cooling segment 307 provides a first function of providing a physical gap between the heater arrangement of the device 51 and the heat sensitive filter arrangement 309, and a second function of enabling the ventilation holes 317 to be located in the cooling segment, whilst also being located outside of the device 51, when the consumable 301 is fully inserted into the device 51. As can be seen from FIGS. 6 and 7, the majority of the cooling element 307 is located within the device 51. However, there is a portion of the cooling element 307 that extends out of the device 51. It is in this portion of the cooling element 307 that extends out of the device 51 in which the ventilation holes 317 are located.

Figure 5:
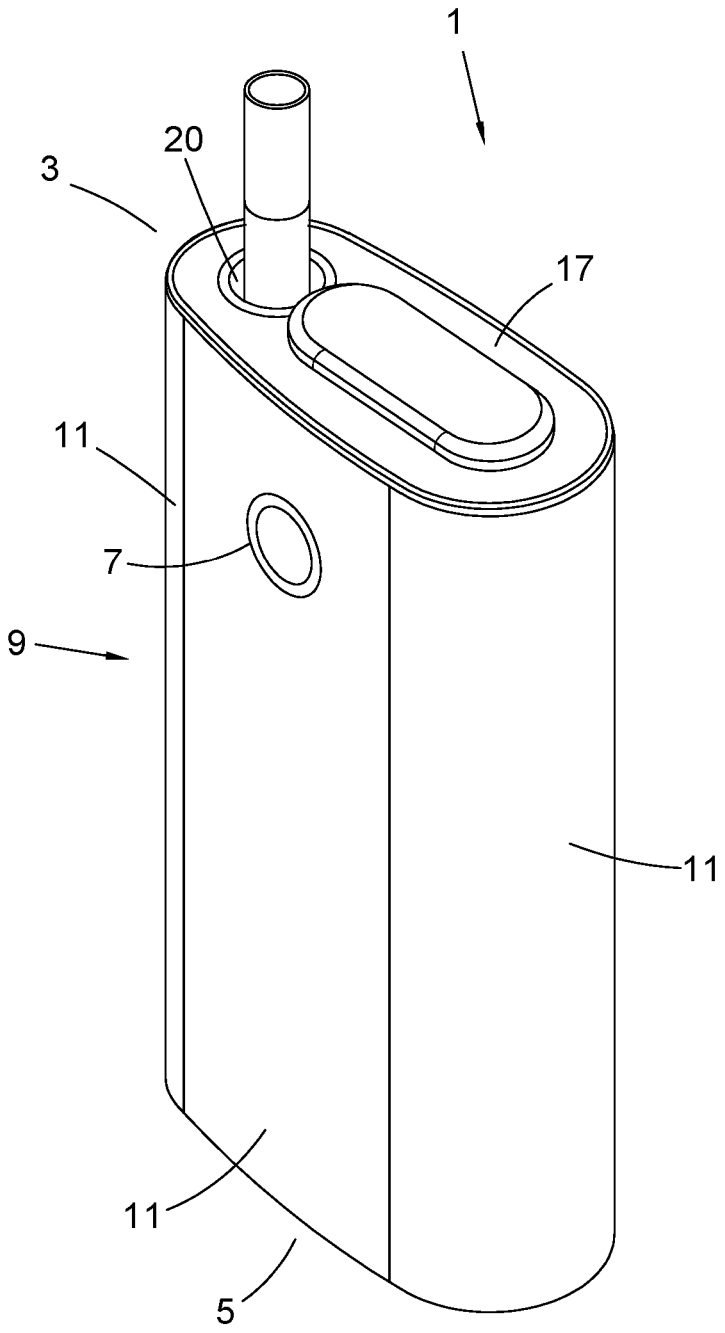
FIG. 5 shows a perspective view of an example of a non-combustible aerosol provision system.

Referring now to FIGS. 5 to 7 in more detail, there is shown an example of a device 51 arranged to heat aerosol-generating material to volatilize at least one component of said aerosol-generating material, typically to form an aerosol which can be inhaled. The device 51 is a heating device which releases compounds by heating, but not burning, the aerosol-generating material.

A first end 53 is sometimes referred to herein as the mouth or proximal end 53 of the device 51 and a second end 55 is sometimes referred to herein as the distal end 55 of the device 51. The device 51 has an on/off button 57 to allow the device 51 as a whole to be switched on and off as desired by a user.

The device 51 includes a housing 59 for locating and protecting various internal components of the device 51. In the example shown, the housing 59 includes a uni-body sleeve 11 that encompasses the perimeter of the device 51, capped with a top panel 17 which defines generally the 'top' of the device 51 and a bottom panel 19 which defines generally the 'bottom' of the device 51. In another example the housing includes a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 51, or may be "permanently" fixed to the uni-body sleeve 11, for example to deter a user from accessing the interior of the device 51. In an example, the panels 17 and 19 are made of a plastics material, including for example glass-filled nylon formed by injection molding, and the uni-body sleeve 11 is made of aluminum, though other materials and other manufacturing processes may be used.

The top panel 17 of the device 51 has an opening 20 at the mouth end 53 of the device 51 through which, in use, the consumable 101, 301 including the aerosol-generating material may be inserted into the device 51 and removed from the device 51 by a user.

The housing 59 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosol-generating material in the consumable 101, 301 as discussed further below.

The power source 27 may be for example a battery, which may be a rechargeable battery or a non-rechargeable battery. Examples of suitable batteries include for example a lithium-ion battery, a nickel battery (such as a nickel-cadmium battery), an alkaline battery and/or the like. The battery 27 is electrically coupled to the heater arrangement 23 to supply electrical power when required and under control of the control circuitry 25 to heat the aerosol-generating material in the consumable (as discussed, to volatilize the aerosol-generating material without causing the aerosol-generating material to burn).

An advantage of locating the power source 27 laterally adjacent to the heater arrangement 23 is that a physically large power source 25 may be used without causing the device 51 as a whole to be unduly lengthy. As will be understood, in general a physically large power source 25 has a higher capacity (that is, the total electrical energy that can be supplied, often measured in Amp-hours or the like) and thus the battery life for the device 51 can be longer.

In one example, the heater arrangement 23 is generally in the form of a hollow cylindrical tube, having a hollow interior heating chamber 29 into which the consumable 101, 301 including the aerosol-generating material is inserted for heating in use. Different arrangements for the heater arrangement 23 are possible. For example, the heater arrangement 23 may include a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminum nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and includes a polyimide heating element. The heater arrangement 23 is dimensioned so that substantially the whole of the body of aerosol-generating material 103, 303 of the consumable 101, 301 is inserted into the heater arrangement 23 when the consumable 101, 301 is inserted into the device 51.

The or each heating element may be arranged so that selected zones of the aerosol-generating material can be independently heated, for example in turn (over time, as discussed above) or together (simultaneously) as desired.

The heater arrangement 23 in this example is surrounded along at least part of its length by a thermal insulator 31. The insulator 31 helps to reduce heat passing from the heater arrangement 23 to the exterior of the device 51. This helps to keep down the power requirements for the heater arrangement 23 as it reduces heat losses generally. The insulator 31 also helps to keep the exterior of the device 51 cool during operation of the heater arrangement 23. In one example, the insulator 31 may be a double-walled sleeve which provides a low pressure region between the two walls of the sleeve. That is, the insulator 31 may be for example a "vacuum" tube, i.e. a tube that has been at least partially evacuated so as to minimize heat transfer by conduction and/or convection. Other arrangements for the insulator 31 are possible, including using heat insulating materials, including for example a suitable foam-type material, in addition to or instead of a double-walled sleeve.

The housing 59 may further includes various internal support structures 37 for supporting all internal components, as well as the heating arrangement 23.

The device 51 further includes a collar 33 which extends around and projects from the opening 20 into the interior of the housing 59 and a generally tubular chamber 35 which is located between the collar 33 and one end of the vacuum sleeve 31. The chamber 35 further includes a cooling structure **35*f*, which in this example, includes a plurality of cooling fins 35*f* spaced apart along the outer surface of the chamber 35, and each arranged circumferentially around outer surface of the chamber 35. There is an air gap 36 between the hollow chamber 35 and the consumable 101, 301 when it is inserted in the device 51 over at least part of the length of the hollow chamber 35. The air gap 36 is around all of the circumference of the consumable 101, 301 over at least part of the cooling segment 307**.

The collar 33 includes a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with an consumable 101, 301 inserted into the device to assist in securing it within the device 51. Open spaces (not shown in the Figures) defined by adjacent pairs of ridges 60 and the consumable 101, 301 form ventilation paths around the exterior of the consumable 101, 301. These ventilation paths allow hot vapors that have escaped from the consumable 101, 301 to exit the device 51 and allow cooling air to flow into the device 51 around the consumable 101, 301 in the air gap 36.

In operation, the consumable 101, 301 is removably inserted into an insertion point 20 of the device 51, as shown in FIGS. 5 to 7. Referring particularly to FIG. 6, in one example, the body of aerosol-generating material 103, 303, which is located towards the distal end 115, 315 of the consumable 101, 301, is entirely received within the heater arrangement 23 of the device 51. The proximal end 113, 313 of the consumable 101, 301 extends from the device 51 and acts as a mouthpiece assembly for a user.

In operation, the heater arrangement 23 will heat the consumable 101, 301 to volatilize at least one component of the aerosol-generating material from the body of aerosol-generating material 103, 303.

The primary flow path for the heated volatilized components from the body of aerosol-generating material 103, 303 is axially through the consumable 101, 301, through the chamber inside the cooling segment 107, 307, through the filter segment 109, 309, through the mouth end segment 111, 313 to the user. In one example, the temperature of the heated volatilized components that are generated from the body of aerosol generating material is between 60° C. and 250° C., which may be above the acceptable inhalation temperature for a user. As the heated volatilized component travels through the cooling segment 107, 307, it will cool and some volatilized components will condense on the inner surface of the cooling segment 107, 307.

In the examples of the consumable 301 shown in FIGS. 3 and 4, cool air will be able to enter the cooling segment 307 via the ventilation holes 317 formed in the cooling segment 307. This cool air will mix with the heated volatilized components to provide additional cooling to the heated volatilized components.

Definitions

Active Substance

In some embodiments, the substance to be delivered includes an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may include for example nicotine, caffeine, taurine, theine, vitamins such as B6 or B12 or C, melatonin, cannabinoids, or constituents, derivatives, or combinations thereof. The active substance may include one or more constituents, derivatives or extracts of tobacco, cannabis or another botanical.

In some embodiments, the active substance includes nicotine. In some embodiments, the active substance includes caffeine, melatonin or vitamin B12.

Botanicals

As noted herein, the active substance may include or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may include an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha* Arventis, *Mentha* c.v., *Mentha niliaca, Mentha piperita, Mentha piperita citrata* c.v., *Mentha piperita* c.v, *Mentha spicata crispa, Mentha cardifolia, Memtha longifolia, Mentha suaveolens variegata, Mentha pulegium, Mentha spicata* c.v. and *Mentha suaveolens*

In some embodiments, the active substance includes or is derived from one or more botanicals or constituents, derivatives or extracts thereof and the botanical is tobacco.

In some embodiments, the active substance includes or derived from one or more botanicals or constituents, derivatives or extracts thereof and the botanical is selected from eucalyptus, star anise, cocoa and hemp.

In some embodiments, the active substance includes or derived from one or more botanicals or constituents, derivatives or extracts thereof and the botanical is selected from rooibos and fennel.

Flavors

In some embodiments, the substance to be delivered includes a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor includes menthol, spearmint and/or peppermint. In some embodiments, the flavor includes flavor components of cucumber, blueberry, citrus fruits and/or redberry. In some embodiments, the flavor includes eugenol. In some embodiments, the flavor includes flavor components extracted from tobacco. In some embodiments, the flavor includes flavor components extracted from cannabis.

In some embodiments, the flavor may include a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Aerosol-Generating Material

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. In some embodiments, the aerosol-generating material may include an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example include from about 50 wt %, 60 wt % or 70 wt % of amorphous solid, to about 90 wt %, 95 wt % or 100 wt % of amorphous solid.

The aerosol-generating material may include one or more active substances and/or flavors, one or more aerosol-former materials, and optionally one or more other functional material.

Aerosol-Former Material

The aerosol-former material may include one or more constituents capable of forming an aerosol. In some embodiments, the aerosol-former material may include one or more of glycerin, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

Consumable

A consumable is an article including or consisting of aerosol-generating material, part or all of which is intended to be consumed during use by a user. A consumable may include one or more other components, such as an aerosol-generating material storage area, an aerosol-generating material transfer component, an aerosol generation area, a housing, a wrapper, a mouthpiece, a filter and/or an aerosol-modifying agent. A consumable may also include an aerosol generator, such as a heater, that emits heat to cause the aerosol-generating material to generate aerosol in use. The heater may, for example, include combustible material, a material heatable by electrical conduction, or a susceptor.

Aerosol Generator

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

For the avoidance of doubt, where in this specification the term "comprises" is used in defining the disclosure or features of the disclosure, embodiments are also disclosed in which the disclosure or feature can be defined using the terms "consists essentially of" or "consists of" in place of "comprises". Reference to a material "comprising" certain features means that those features are included in, contained in, or held within the material.

The above embodiments are to be understood as illustrative examples of the disclosure. Further embodiments of the disclosure are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol-generating material comprising an amorphous solid, wherein the amorphous solid comprises:

a gelling agent;

an aerosol-forming material;

a flavorant and/or active substance; and a filler;

wherein the filler extends only partially through a thickness of the amorphous solid;

wherein the amorphous solid is in the form of a sheet; and wherein the filler comprises fibers which are dispersed throughout the full thickness of the amorphous solid and which do not span the full thickness of the amorphous solid.

2. The aerosol-generating material according to claim 1, wherein the amorphous solid comprises a first portion and a second portion;

wherein the first portion comprises from about 0 wt % to about 25 wt % of the filler present in the amorphous solid; and wherein the second portion comprises at least about 75 wt % of the filler present in the amorphous solid, these weights being calculated on a dry weight basis.

3. The aerosol-generating material according to claim 2, wherein the first portion comprises a first planar surface and the second portion comprises a second planar surface opposed to the first planar surface, wherein the filler is exposed at no more than one of the first planar surface and second planar surface of the amorphous solid.

4. The aerosol-generating material according to claim 1, wherein the fibers extend through less than about 90% of the thickness of the amorphous solid.

5. The aerosol-generating material according to claim 1, wherein a length of about 25 wt % to about 100 wt % of the fibers in the amorphous solid is less than the thickness of the amorphous solid.

6. The aerosol-generating material according to claim 1, wherein a length of each fiber of the filler comprising fibers is less than the thickness of the amorphous solid.

7. The aerosol-generating material according to claim 1, wherein the fibers comprise wood fibers.

8. The aerosol-generating material according to claim 1, wherein the fibers comprise polymeric fibers.

9. The aerosol-generating material according to claim 1, wherein the amorphous solid comprises the flavorant, and wherein the flavorant comprises menthol.

10. A consumable for use within a non-combustible aerosol provision system, the consumable comprising an aerosol-generating material comprising the amorphous solid of claim 1.

11. A non-combustible aerosol provision system comprising a consumable and a non-combustible aerosol provision device, the non-combustible aerosol provision device comprising an aerosol-generation device arranged to generate aerosol from the consumable when the consumable is used with the non-combustible aerosol provision device, and wherein the consumable comprises an aerosol-generating material comprising the amorphous solid of claim 1.

* * * * *